US008388401B2

(12) United States Patent
Lanahan

(10) Patent No.: US 8,388,401 B2
(45) Date of Patent: Mar. 5, 2013

(54) STRUCTURED ARRAYS AND ELEMENTS FOR FORMING THE SAME

(76) Inventor: Samuel Lanahan, Portland, OR (US)

( * ) Notice: Subject to any disclaimer, the term of this patent is extended or adjusted under 35 U.S.C. 154(b) by 201 days.

(21) Appl. No.: 12/776,212

(22) Filed: May 7, 2010

(65) Prior Publication Data

US 2011/0271633 A1 Nov. 10, 2011

(51) Int. Cl.
*A63H 33/06* (2006.01)

(52) U.S. Cl. ..... 446/120; 446/118; 52/646; 52/653.2

(58) Field of Classification Search ..... 52/645, 52/646, 650.3, 653.2; 446/117, 118, 120, 446/121; 285/120.1
See application file for complete search history.

(56) References Cited

U.S. PATENT DOCUMENTS 824,501 A * 6/1906 Molloy ..... 52/653.2
2,682,235 A 6/1954 Fuller
3,063,521 A 11/1962 Fuller
3,169,611 A 2/1965 Snelson
3,236,004 A * 2/1966 Christiansen ..... 446/102
3,354,591 A 11/1967 Fuller
3,510,962 A 5/1970 Sato
3,566,531 A * 3/1971 Hasel ..... 446/120
3,586,645 A 6/1971 Granger
3,611,620 A * 10/1971 Perry ..... 446/121
3,722,153 A 3/1973 Baer
3,822,499 A * 7/1974 De Vos ..... 446/121
3,866,366 A 2/1975 Fuller
3,925,941 A 12/1975 Pearce
(Continued)

FOREIGN PATENT DOCUMENTS

DE 3306051 8/1984
FR 2570614 A1 * 3/1986
(Continued)

OTHER PUBLICATIONS

Cornelissen et al., "The *p*-adic Icosahedron," *Notices of the AMS* 52(7):720-727, 2005.

(Continued)

*Primary Examiner* — Brian Glessner
*Assistant Examiner* — Adriana Figueroa
(74) *Attorney, Agent, or Firm* — Klarquist Sparkman, LLP

(57) ABSTRACT

A plurality of structural members configured to be coupled together to form an array. Each structural member includes a top portion having a plurality of top extending members spaced apart from one another and a bottom portion having a plurality of bottom extending members spaced apart from one another. The top extending members and bottom extending members can be vertically offset from each other. The top portion of each structural member can be coupled to the bottom portion of another structural member, and each top extending member of a structural member can be coupled to a bottom extending member of another structural member.

21 Claims, 10 Drawing Sheets

U.S. PATENT DOCUMENTS

| | | | | | |
|---|---|---|---|---|---|
| 3,953,948 | A | | 5/1976 | Hogan | |
| 3,970,301 | A | | 7/1976 | Lehmann | |
| 4,207,715 | A | | 6/1980 | Kitrick | |
| 4,238,905 | A | | 12/1980 | MacGraw | |
| 4,582,495 | A | * | 4/1986 | Orgass et al. | 446/102 |
| 4,701,131 | A | | 10/1987 | Hildebrandt et al. | |
| 4,719,726 | A | | 1/1988 | Bergman | |
| 4,723,382 | A | | 2/1988 | Lalvani | |
| 4,744,780 | A | * | 5/1988 | Volpe | 446/128 |
| 4,823,532 | A | * | 4/1989 | Westerburgen | 52/592.6 |
| 4,964,834 | A | * | 10/1990 | Myller | 446/118 |
| RE33,785 | E | | 12/1991 | Hildebrandt et al. | |
| 5,524,396 | A | | 6/1996 | Lalvani | |
| 5,827,105 | A | * | 10/1998 | Felgenhauer et al. | 446/120 |
| 5,906,530 | A | | 5/1999 | Lindsey | |
| 6,050,044 | A | * | 4/2000 | McIntosh | 52/591.1 |
| 6,050,873 | A | * | 4/2000 | Reisman | 446/128 |
| 6,282,849 | B1 | | 9/2001 | Tuczek | |
| 6,379,212 | B1 | | 4/2002 | Miller | |
| 6,531,107 | B1 | | 3/2003 | Spencer et al. | |
| 6,645,033 | B1 | * | 11/2003 | Thomsen | 446/120 |
| 6,648,715 | B2 | * | 11/2003 | Wiens et al. | 446/121 |
| 6,672,789 | B2 | | 1/2004 | Chen | |
| 6,739,937 | B2 | | 5/2004 | Snelson | |
| 6,841,456 | B2 | | 1/2005 | Hersee et al. | |
| 6,965,026 | B2 | | 11/2005 | Zaworotko et al. | |
| 7,063,587 | B1 | * | 6/2006 | Lin | 446/124 |
| 7,452,578 | B2 | | 11/2008 | Lanahan | |
| 7,694,463 | B2 | | 4/2010 | Lanahan | |
| 7,954,296 | B2 | * | 6/2011 | Newland | 52/655.1 |
| 8,007,338 | B2 | * | 8/2011 | Stevkovski | 446/120 |
| 2001/0016283 | A1 | | 8/2001 | Shiraishi et al. | |
| 2003/0082986 | A1 | * | 5/2003 | Wiens et al. | 446/120 |
| 2004/0155518 | A1 | | 8/2004 | Schlanger | |
| 2004/0158999 | A1 | | 8/2004 | Trantow | |
| 2006/0234600 | A1 | | 10/2006 | Pacheco | |
| 2007/0256370 | A1 | | 11/2007 | Whittingham | |
| 2008/0040984 | A1 | | 2/2008 | Lanahan | |

FOREIGN PATENT DOCUMENTS

| | | | |
|---|---|---|---|
| GB | 2231502 | A * | 11/1990 |
| JP | 04330140 | | 11/1992 |
| WO | WO 2006/028903 | | 3/2006 |
| WO | WO 2008/020843 | | 2/2008 |

OTHER PUBLICATIONS

Fuller, E.B., "Allspace-Filling Tensegrity Arrays," *Synergetics*, pp. 428-431 (1975).

Georgakilas et al., "Supramolecular self-assembled fullerence nanostructures," *PNAS* 99(8):5075-5080, 2002.

Pearce, Peter, Structure in Nature is a Strategy for Design, Ch.11, "Infinite Spatial Networks from Equilateral Triangles," pp. 144-153 (1978).

Rittenhouse et al., "Filling in the Hexagonal Close-Packed Unit Cell," *Journal of Chemical Education*, http://jchemed.chem.wisc.edu/JCEWWW/Articles/FillingHCP/FillingHCP.ptml, 7 pp. (downloaded May 18, 2006).

"DNA Technique Yields 3-D Crystalline Organization of Nanoparticles," *Center for Fucntional Nanomaterials* http://www.bnl.gov/cfn/news/PRdisplay.asp?prID=07-127 (downloaded Mar. 12, 2008).

"The Icosahedron Fractal," http://www.public.asu.edu/~starlite/icosahedronfractal.html (downloaded Mar. 10, 2008).

"Platonic Solid," http://mathworld.wolfram.com/PlatonicSolid.html, 6 pp. (downloaded May 18, 2006).

International Search Report and Written Opinion for PCT/US05/31145.

International Search Report and Written Opinion for PCT/US06/31940.

* cited by examiner

STRUCTURED ARRAYS AND ELEMENTS FOR FORMING THE SAME

FIELD

This application relates to novel structural elements and arrays, and in particular, to structural elements and arrays that can be connected together to form an omni-extensible array.

BACKGROUND

Any useful physical structure, device or material (hereinafter "structure) must be adapted so that the structure can withstand the forces that are applied to that structure. Although various structures have been developed over the years for building materials or other applications these structures are generally limited by weakness inherent in their geometry.

It is desirable to provide structural members that provide enhanced structural integrity, high strength-to-weight ratios, and the ability to adapt to various needs associated with a particular structural design.

SUMMARY

In one embodiment, a plurality of structural members are configured to be coupled together to form an array. Each structural member comprises a top portion having a plurality of top extending members spaced apart from one another and a bottom portion having a plurality of bottom extending members spaced apart from one another, the top extending members and bottom extending members being vertically offset from each other. The top portion of each structural member is configured for coupling to the bottom portion of another structural member, and each top extending member of a structural member is configured to be coupled to a bottom extending member of another structural member.

In certain embodiments, each structural member can comprises three top extending members and three bottom extending members. The first and second openings can be offset along a central axis of the structural member by about 60 degrees. In other embodiments, each top extending member and bottom extending member can comprise a connector-receiving opening and the plurality of structural members can comprise a plurality of connecting members. Each connecting member can have a first end that is received into a connector-receiving opening of one top extending member and a second end that is received into a connector-receiving opening of one bottom extending member. Each structural member can be substantially solid or substantially hollow.

In other embodiments, each of the plurality of top extending members can have a first opening and each of the plurality of bottom extending members can have a second opening, and a passageway can extend between each first opening and a corresponding, offset second opening. Each first opening of a first structural member can be fluidly connected to only one second opening of the first structural member. At least one passageway can have a convoluted path between the first opening and the second opening. At least one passageway can have a restricted cross-section area along a portion of the passageway. Each structural member can have three first openings and three second openings.

In other embodiments, each of the three first openings can have a centerpoint and the three centerpoints of the first openings can define a first equilateral triangle, and each of the three second openings can have a centerpoint and the three centerpoints of the second openings can define a second equilateral triangle. The first equilateral triangle can be larger than the second equilateral triangle. Each of the first openings of the structural members can be defined by an extending portion and each of the second openings of the structural member can be configured to receive an extending portion of another structural member at least partially into the second opening to couple the two structural members together. Each extending portion of a first structural member can be configured to be received at least partially into the second opening of a different structural member, such that three extending portions of a first structural member can be coupled to three other structural members.

In other embodiments, a movement restricting member to restrict relative movement of two coupled structural members when at least one extending portion is received in the second opening of another structural member. The movement restricting member can have a lip on one or both of the extending portions and the second openings.

In another embodiment, a plurality of structural members can be configured to be coupled together to form an array. Each structural member can comprise a top face having three first joining members arranged such that a plurality of centerpoints of the first joining members collectively define a first equilateral triangle, and a bottom face having three second joining members such that a plurality of center points of the second joining members collectively define a second equilateral triangle. At least some of the first joining members of the structural members can be configured to mate with at least some of the second joining members of other structural members to couple the plurality of structural members together.

In other embodiments, the first and second equilateral triangles can be offset from one another along a central axis of the structural member by an angle of about 60 degrees. The first equilateral triangle can be larger than the second equilateral triangle. Each first joining member of a first structural member can be configured to be joined with one of the second joining members of a different structural member, such that the three first joining members of the first structural member are coupled to three other structural members.

In other embodiments, the first joining members can include extending portions that extend from the top face of the structural members and the second joining members can include openings that are sized to receive the first joining members of another structural member. A movement restricting member can be provided to restrict relative movement of two coupled structural members when at least one extending portion is received in the second opening of another structural member. The movement restricting member can comprise a lip on one or both of the extending portions and the second openings.

In another embodiment, an omni-extensible array of structural elements can be provided. The array can comprise a first layer of structural elements and a second layer of structural elements. The structural elements can include a top face having three first joining members arranged such that a plurality of centerpoints of the first joining members collectively define a first equilateral triangle and a bottom face having three second joining members such that a plurality of center points of the second joining members collectively define a second equilateral triangle. At least some of the first joining members can be configured to mate with at least some of the second joining members to couple the first layer of structural elements to the second layer of structural elements. Each structural element in the array can be coupled to three different structural elements in a layer above the structural element and three different structural elements in a layer below the structural element.

In other embodiments, the first and second equilateral triangles of each structural member can be offset from one another with respect to a central axis of the structural member by an angle of about 60 degrees. In other embodiments, the first equilateral triangle can be larger than the second equilateral triangle.

The foregoing and other objects, features, and advantages of the disclosed embodiments will become more apparent from the following detailed description, which proceeds with reference to the accompanying figures.

DETAILED DESCRIPTION

The following description is exemplary in nature and is not intended to limit the scope, applicability, or configuration of the invention in any way. Various changes to the described embodiment may be made in the function and arrangement of the elements described herein without departing from the scope of the invention.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" and "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

Figure 1:
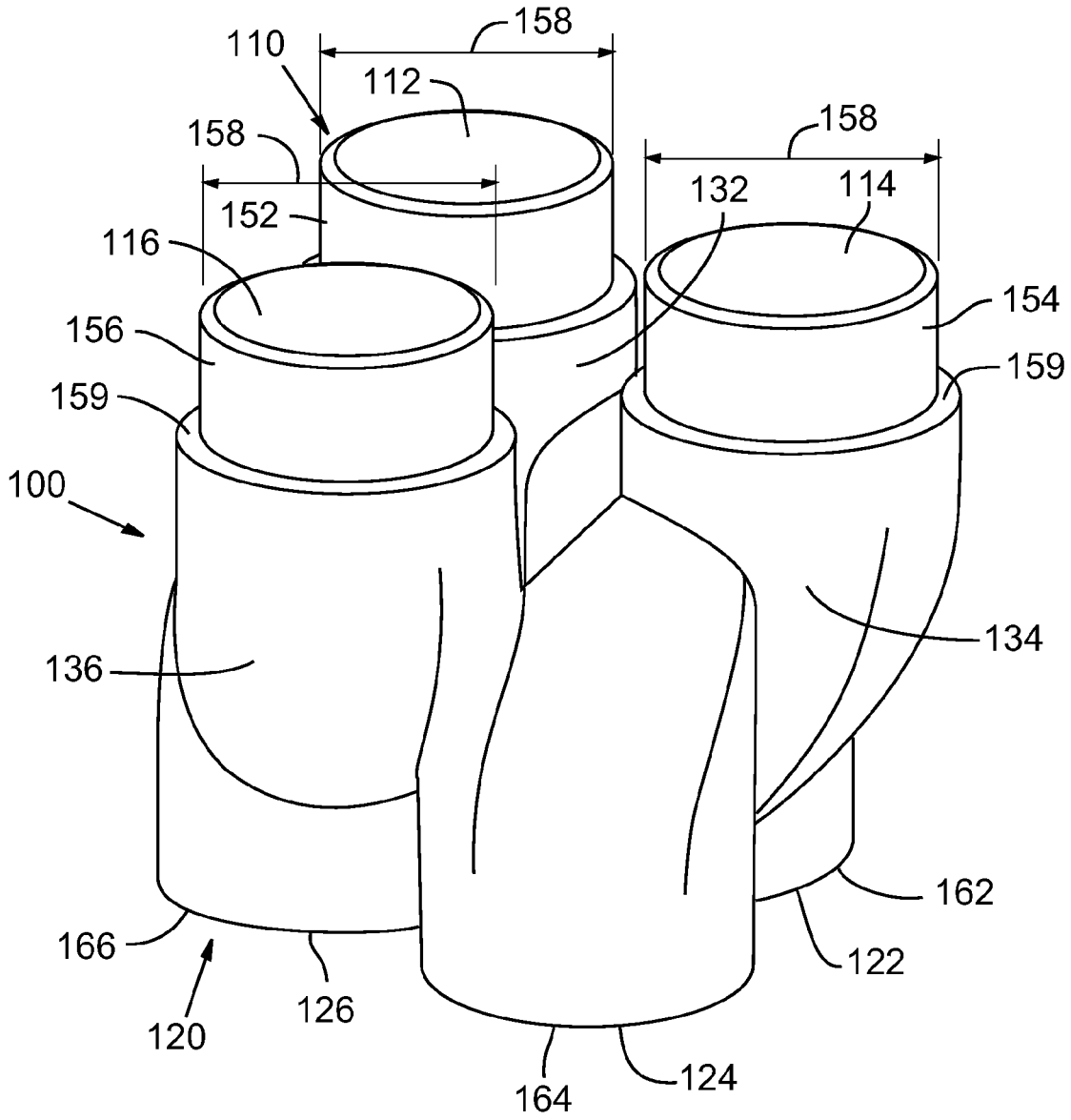
FIG. 1 is a top perspective view of a structural member that has a plurality of passageways extending from a first surface to a second surface.

FIG. 1 illustrates a structural member 100 that has at least one passageway extending between a top surface (face) 110 and a bottom surface (face) 120 of the structural member. The terms "top" and "bottom" are used to conveniently describe the structural member in the various figures based on the orientation shown in FIG. 1. However, it should be understood that the structural member and arrays of structural members described herein can be used or positioned in any desired orientation, including, for example, in the orientation shown in FIG. 1, an orientation where the structural member is opposite from that shown in FIG. 1 (e.g., "upside-down"), or any other orientation between those two orientations. In addition, the top and bottom "surfaces" or "faces" of structural member 100 generally refer to a portion of the respective top and bottom surfaces that is located at or near the "top" and "bottom" of structural member 100. The surfaces and/or faces described herein can be located in the same plane; however, they can also include elements that are non-planar but which otherwise generally "face" outwardly from the respective top and bottom of structural member 100.

As shown in FIG. 1, structural member 100 can comprise a plurality of openings in top surface 110, such as a first top opening 112, a second top opening 114, and a third top opening 116, and a plurality of openings in bottom surface 120, such as a first bottom opening 122, a second bottom opening 124, and a third bottom opening 126.

Each of bodies 132, 134, 136 is preferably generally hollow so that each defines a passageway that fluidly connects the respective top and bottom openings of structural member 100. Thus, each opening in a top surface 110 of structural member 100 is fluidly connected to a respective opening in a bottom surface 120 of structural member 100. For example, as shown in FIG. 1, opening 112 can be fluidly connected with opening 122, opening 114 can be fluidly connected with opening 124, and opening 116 can be fluidly connected with opening 126. The term fluidly connected refers to the presence of a passageway between respective top and bottom openings such that a fluid or other flowable element (e.g., liquid, gas, flowable solid particles) can pass through the structural member from the top surface to the bottom surface and/or vice versa. The term fluidly connected does require the presence or passage of fluid or other flowable elements in a passageway, just the ability to allow the passage of fluid or other flowable elements therethrough.

As discussed above, structural member 100 preferably defines a plurality of passageways between fluidly connected respective top openings (112, 114, 116) and bottom openings (122, 124, 126). Each body 132, 134, 136 is also preferably connected and/or structural integrated to each of the other bodies 132, 134, and 136 as shown in FIG. 1. Bodies 132, 134, 136 can be connected in various ways, including, for example, mechanical, chemical, or other physical connecting means. In one embodiment, bodies 132, 134, 136 can be integrally formed as a single structural element. By connecting bodies 132, 134, 136 to one another in a fixed relationship, each pair of fluidly connected openings, 112 and 122, 114 and 124, and 116 and 126, can be similarly fixed relative to one another, which can provide for a predictable structure and also facilitate the interconnection of multiple structural members 100 as described in more detail below (see, e.g., FIGS. 4 and 5).

Figure 2:
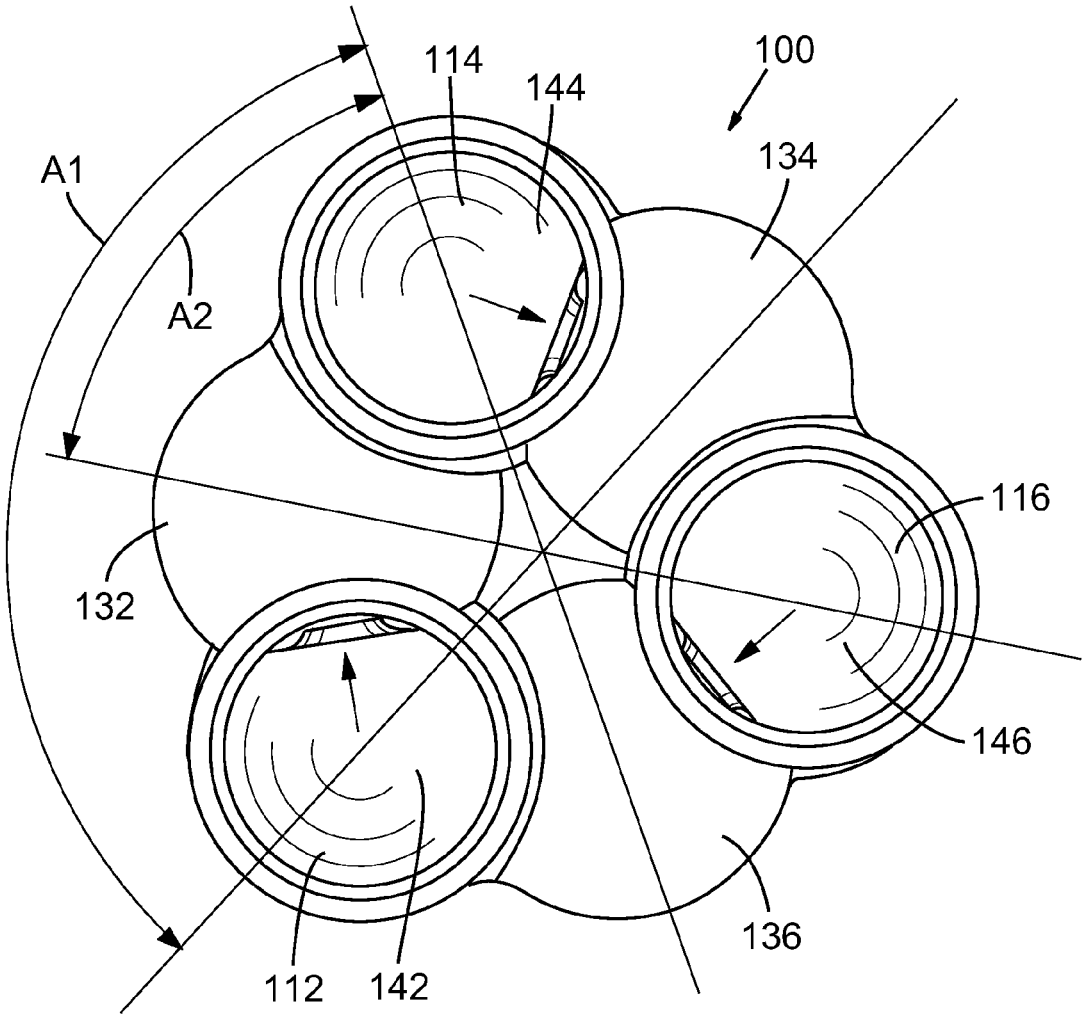
FIG. 2 is a top view of the structural member of FIG. 1.
Figure 3:
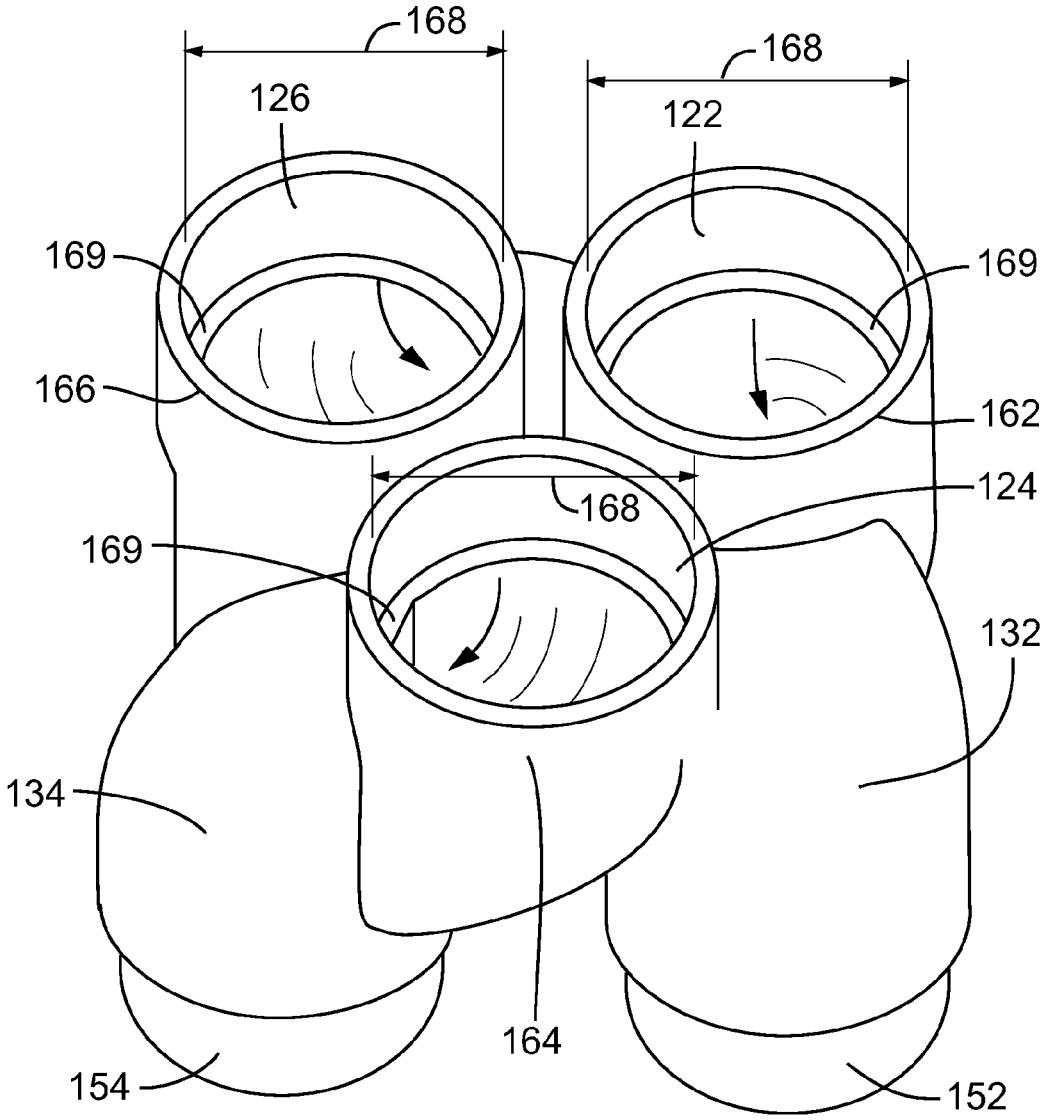
FIG. 3 is a bottom perspective view of the structural member of FIG. 1.

FIG. 2 is a top view of structural member 100. In the illustrated embodiments, the three bodies 132, 134, 136 are integrally formed with each other to form a single, integral structural member 100. As discussed above, a plurality of defined passageways extend between top face 110 and a bottom face 120. As shown in FIG. 2, the plurality of passageways include passageway 142 (defined by body 132), passageway 144 (defined by body 134), and passageway 146 (defined by body 136). FIGS. 2 and 3 have an arrow in each passageway to indicate a general direction of flow from a top face to a bottom face. It should be noted that the flow direction shown in FIGS. 2 and 3 can vary if the structural member is not in the upright configuration shown in FIG. 2 and/or flow is not directed by downward, such as by gravity.

An interior surface of the passageways can be formed in a variety of manners. The interior surface of one or more passageways can be generally smooth as shown in FIG. 2. Alternatively, the interior surfaces of one or more passageways can be formed with ridges, projections, or other superficial elements that alter or affect the flow path (or other property) of passageways 142, 144, 146. For example, if it is desirable to encourage mixing of a fluid or other flowable material, the internal surfaces can include fins or other members that cause or increase the turbulent flow of that fluid or material through one or more of passageways 142, 144, 146.

Openings in the top and bottom surface that are fluidly connected are preferably offset from one another. This offset can provide structural integrity and strength to structural member 100. In addition, if structural member 100 is configured to allow fluids to flow between the top and bottom surfaces (e.g., through the passageways defined and/or provided through the structural member), the offset openings can be used to influence or modify the flow of the flowing element (e.g., gas, fluid, or flowable solids) through the passageways. For example, the offset can define a convoluted path between the openings in the top and bottom surfaces. Such a convoluted path can cause the flowing element to experience non-laminar flow between the top and bottom surfaces. Such non-laminar flow can provide various advantages, such as mixing or blending one or more fluids or other flowing elements. Additionally, at least a portion of one or more passageways can include a restricted cross-sectional area along the passageway to further affect the flow pattern of any flowable element moving through the passageway.

As shown in FIG. 2, the offset of the top and bottom openings can be at an angle A1 that is measured from a centerline of each opening. Angle A1 can vary; however, it is preferably at an angle of about 60 degrees. Thus, an angle A2 formed between a centerline of each opening on a single surface (e.g., the top surface or bottom surface) is preferably about 120 degrees.

Each top opening of a first structural member 100 can be configured so that it can be coupled with a bottom opening of a second structural member 100. In one embodiment, first, second, and third top openings 112, 114, 116 can be formed with a different diameter than first, second, and third bottom openings 122, 124, 126 to allow for one of the top or bottom openings to receive a bottom or top portion of another structure member therein to couple two or more structural members together. For example, as shown in FIG. 1, structural members 100 can comprise a plurality of top extending portions 152, 154, 156, which define top openings 112, 114, 116, respectively, and a plurality of bottom portions 162, 164, 166, which define bottom openings 122, 124, and 126, respectively. Top extending portions 152, 154, 156 can have an outer diameter 158 that is smaller than an inner diameter 168 (FIG. 3) of bottom portions 162, 164, 166 so that top extending portions 152, 154, 156 can be received within bottom portions 162, 164, 166.

Thus, the inner diameter 168 of bottom portions 162, 164, 166 of structural member 100 can be sized to receive top extending portions 152, 154, 156 of another structural member 100 so that a plurality of structural members 100 can be coupled together. Since the top extending portions and bottom portions with openings cooperate with one another to join or couple a first structural member to a second structural member that is positioned above or below the first structural member, top extending portions and bottom portions are also referred to herein as joining members.

As shown in FIGS. 1 and 3, each top extending portions 152, 154, 156 can have the same size outer diameter 158 and each bottom portions 162, 164, 166 can have the same size inner diameter 168. However, structural members 100 could be configured to have different sized top extending portions and different sized bottom portions, so long as the diameters of each respective mating top extending portion and bottom portion are configured to allow those surfaces or areas to be coupled together.

If desired, a movement restricting member 159, such as a lip or ledge, can be provided on or adjacent to each top extending member 152, 154, 156. Movement restricting member 159 can act as a stop which restricts further relative movement between a top extending portion and a bottom portion when the top extending portion is fully received into the bottom portion. Similarly, as shown in FIG. 3, an internal lip, ledge, or other movement restriction member 169 can be positioned on or at an internal surface of the openings 122, 124, 126 formed by bottom portions 162, 164, 166 to restrict further movement of top extending portions into the opening defined by bottom portions 162, 164, 166.

If desired, other movement restricting members can be used to secure a first structural member 100 to a second structural member 100. Although the movement restricting members 159, 169 described above restrict movement in only one direction (e.g., movement restricting member 159 restricts movement of the top extending portion into, but not out of, the bottom portion) other movement restricting members that restrict movement in both directions can be provided. For example, locking mechanisms such as a snap-fit configuration with a biased locking member could be used to more securely couple two structural members together.

Figure 4:
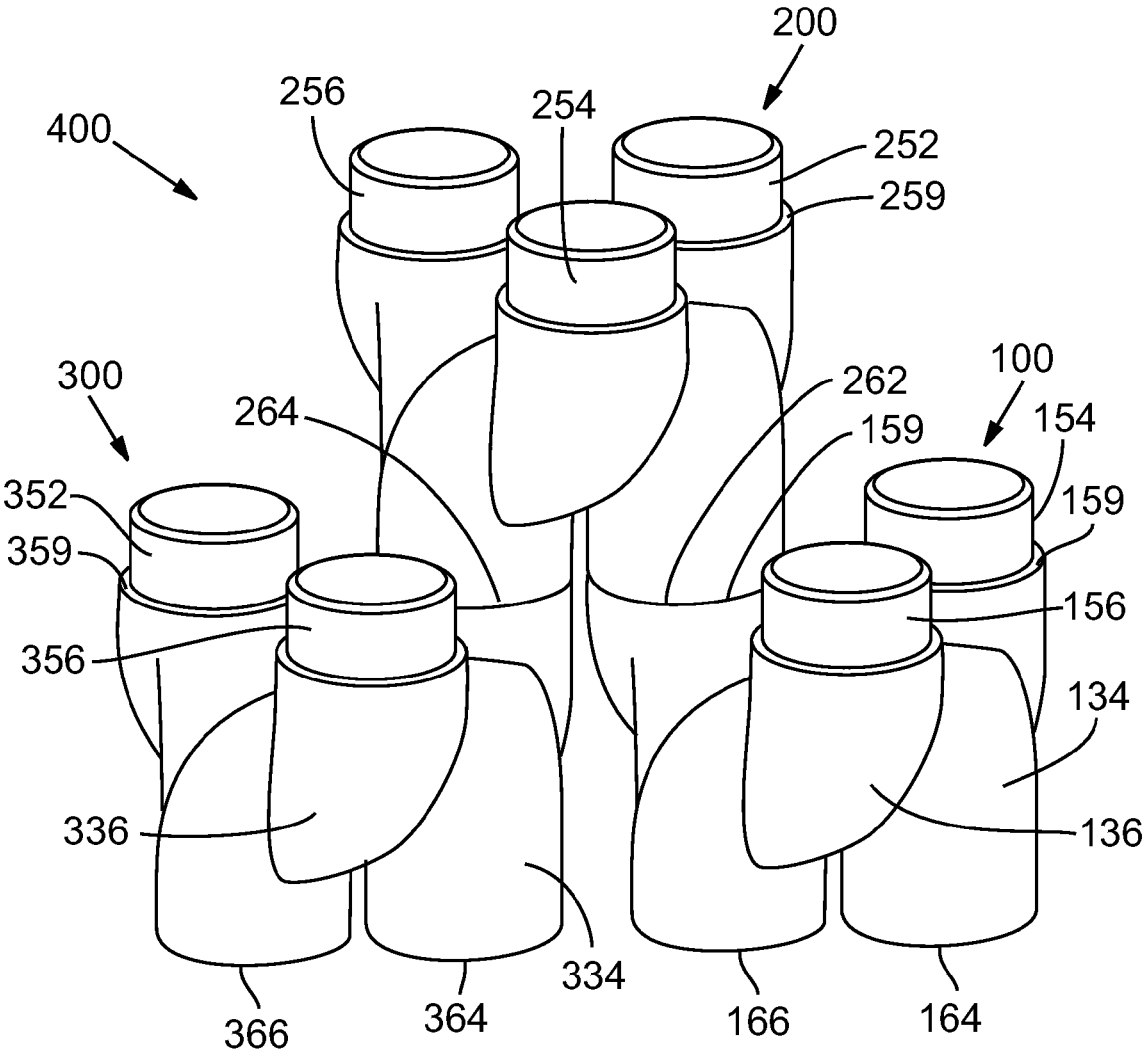
FIG. 4 is a top perspective view of a plurality of structural members coupled together to form an array of structural members.

Referring to FIG. 4, three or more structural members 100, 200, 300 can be coupled together to form an array 400. Each structural member 100, 200, 300 is preferably generally identical to the others and therefore, for convenience, the features of structural members 200 and 300 (and other structural members described herein) that correspond to those of structural member 100 will be referred to using the same two ending digits.

FIG. 4 illustrates a second structural member 200 positioned on and coupled to a first structural member 100 so that a bottom portion 262 of second structural member 200 receives a top extending portion 152 (not shown as it is positioned inside of bottom portion 262) into an opening 222 formed by bottom portion 262. Movement restricting members 159, 269 restrict relative movement between second structural member 200 and first structural member 100. Second structural member 200 is also positioned on and coupled to a third structural member 300. In the coupling between second structural member 200 and third structural member 300, a bottom portion 264 of second structural member 200 receives a top extending portion 354 (not shown as it is positioned inside of bottom portion 264) into an opening 224 formed by bottom portion 264. Again, movement restricting members 159, 269 restrict relative movement between second structural member 200 and third structural member 300.

FIG. 4 illustrates only three structural members coupled together to form array 400. However, it should be understood that array 400 can comprise any number of structural members greater than one. Preferably, the array comprises at least four structural members coupled together so that at least one side (e.g., a top or bottom) of a first structural member is coupled to three other structural members. Thus, because each side of a structural member comprises three joining members (e.g., three extending portions or three bottom portions that define openings for receiving extending portions), a first structural member can be coupled to one joining member of each of the other three structural members.

Array 400 also comprises at least two layers (e.g., rows) of structural members. Referring to FIG. 4, a first layer comprises structural elements 100, 300 and a second layer comprises structural element 200. The array is omni-extensible since additional structural members can be added to increase the size of the array (e.g., vertically by increasing the number of layers of structural members and/or horizontally by increasing the size of any one layer). Thus, the array is scalable by varying the number of structural elements. In addition, the array is scalable in that the size of individual structural elements can be varied ranging from a very small size (e.g., measurable on the nano-scale) to a very large size (e.g., measurable in meters or larger).

Figure 5:
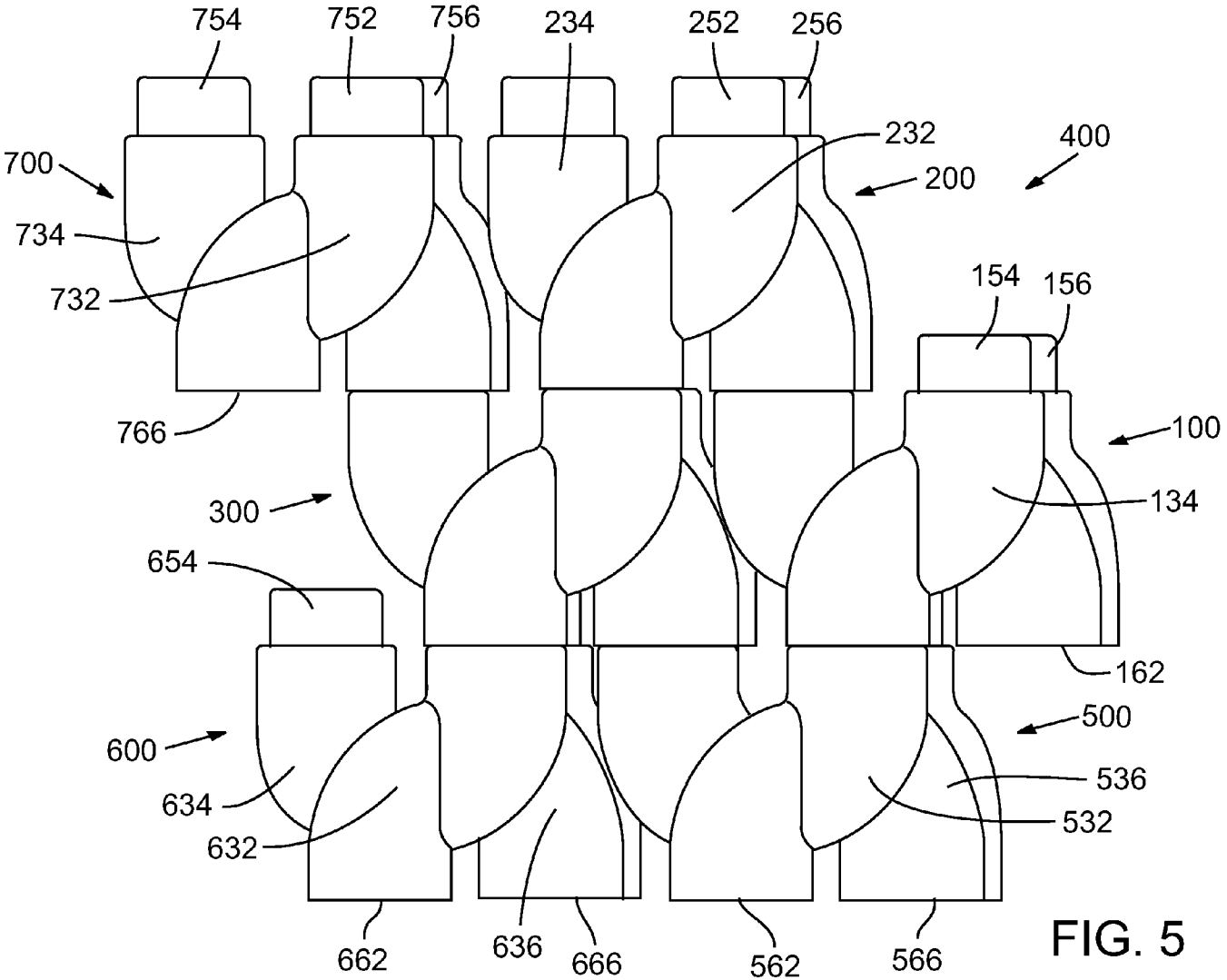
FIG. 5 is a side view of an array of structural members having a plurality of layers or rows.

FIG. 5 illustrates another embodiment of an array 450 formed of a plurality of structural members. Array 450 comprises three layers of structural members 100, 200, 300, 500, 600, 700 that are coupled together to form array 450. The first layer of array 450 comprises structural members 500, 600, the second layer comprises structural members 100, 300, and the third layer comprises structural members 200, 700. As discussed above, array 450 is preferably omni-extensible. Thus, as shown in FIG. 5, joining members of additional structural members can be joined to available complementary joining members of structural elements of the existing array 450. For example, structural member 100 in the second layer of array 450 has at least two available joining members for extending the adjacent layers of array 450. Thus, a top extending portion 154 of structural element 100 can receive a complementary bottom portion of another structural element to extend the third layer. Similarly, a top extending portion of another structural element can be receive in the complementary bottom portion 162 of structural member 100 to extend the first layer.

The omni-extensible pattern of structural members is also inherently stable and ordered. The stability is a result of the structural strength of the individual structural members and the array's ability to constrain a plurality of those members in each of the six-degrees of freedom (up, down, left, right, front, back) of the array. Moreover, as best seen in FIG. 2, the three joining members on each side of a structural member are configured to be in a triangular relationship. In particular, the three joining members on each side preferably form a generally equilateral triangular shape defined by a virtual point at the center of each joining member. To facilitate coupling of a plurality of structural members together, the size of the equilateral triangles formed by the centerpoints on the top side of the structural member can be different from the size of the equilateral triangles formed by the centerpoints on the bottom side of the structural member. For example, the triangle on the top side of the structural member can be larger than the triangle on the bottom side of the structural member.

Triangles are structurally strong geometric shapes and, therefore, it is desirable that the joining members be formed with generally triangular shapes as shown in FIG. 2. Triangular shapes perform well under both compression and tension. The strength of triangular structures can be seen, for example, with the following example. Under heavy loads of compression a square can begin to distort or show signs of failure; however, with the addition of a diagonal brace element, the square can effectively be transformed into two triangular shapes and the resulting structure is much more resistant to deformation.

Figure 6:
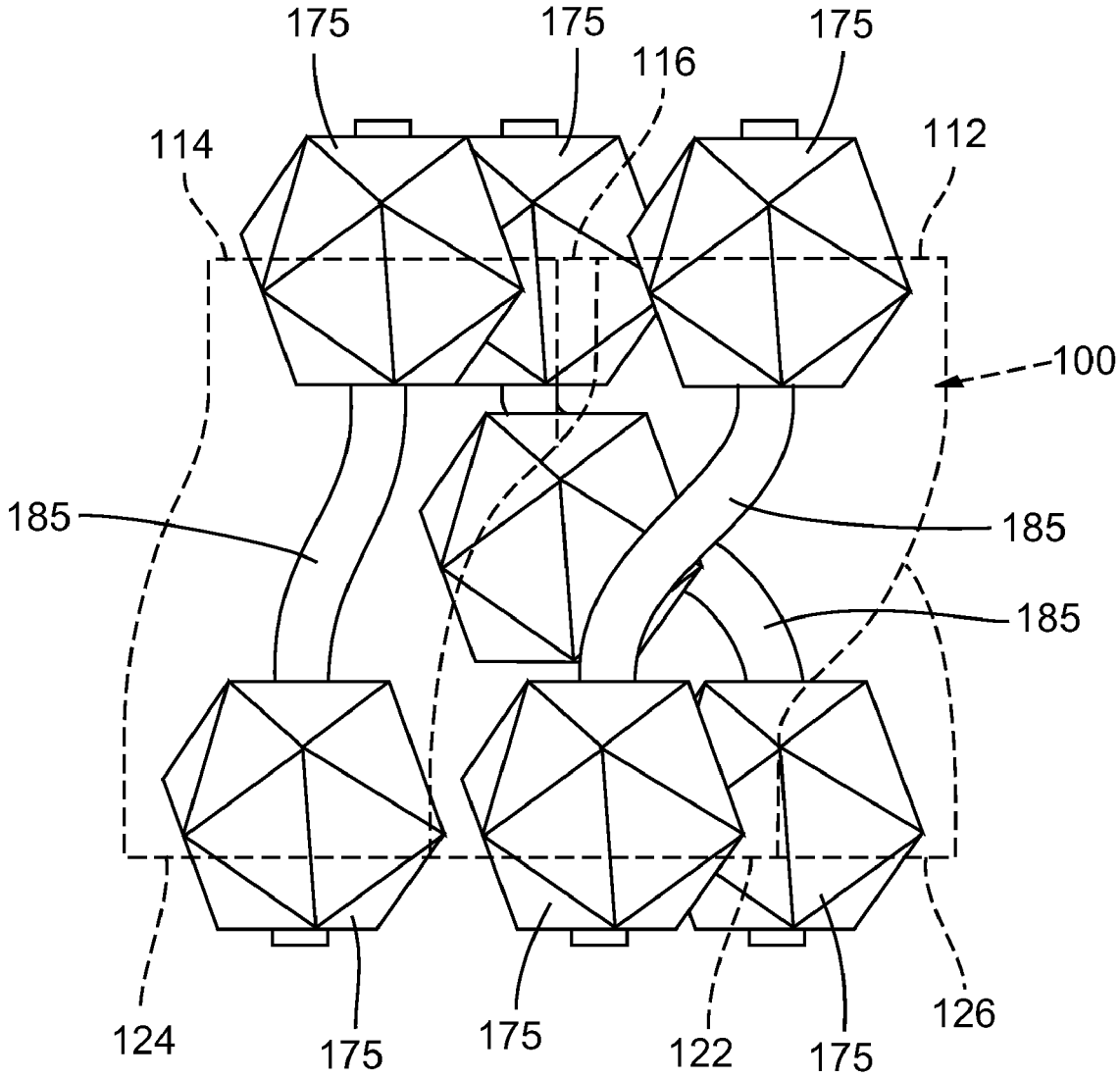
FIG. 6 is a schematic side view showing a possible relationship between a structural member and an array of polyhedrals.
Figure 7:
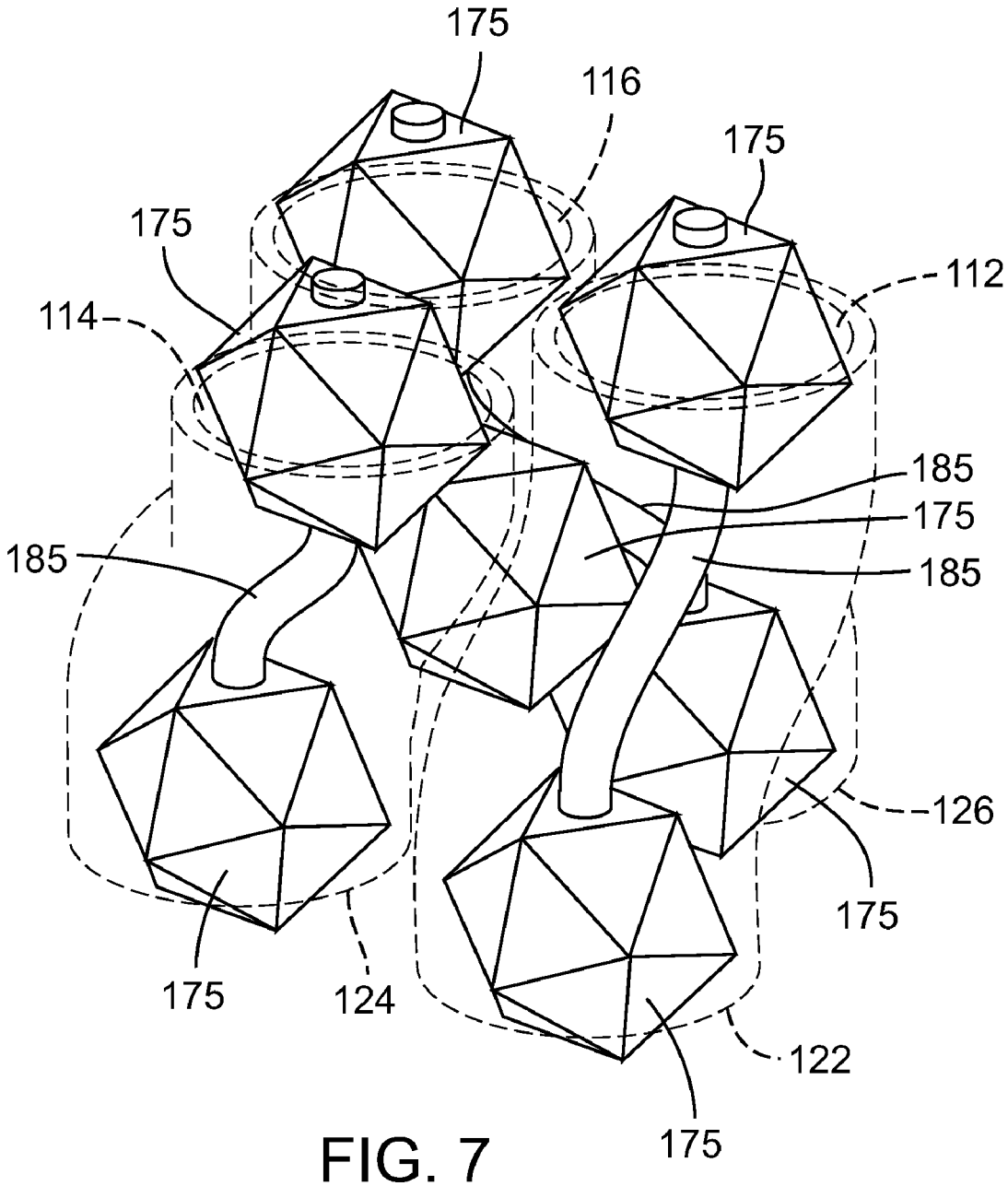
FIG. 7 is a schematic perspective view showing a possible relationship between a structural member and an array of polyhedrals.

To further strengthen the structural member, the relative orientations of joining members (e.g., top extending portions and bottom portions that define openings for receiving the top extending portions) are preferably selected to produce a structure that generally follows the structure of a polyhedral array, as generally described in U.S. Patent Publication No. 2008/0040984, the entire disclosure of which is hereby incorporated by reference. FIGS. 6 and 7 illustrate generally how the structural members disclosed herein can generally conform to the structure of a polyhedral array.

FIGS. 6 and 7 illustrate structural member 100 with a plurality of icosahedrons forming an array, as defined in U.S. Patent Publication No. 2008/0040984, schematically positioned within structural member 100. As shown in FIGS. 6 and 7, by generally orienting the virtual center of top openings 112, 114, 116 and the virtual center of bottom openings 122, 124, 126 at the location of icosahedrons or members 175 of an icosahedral array, the structural integrity of the structural member can benefit from the inherent structural stability of an icosahedral array, as described in more detail in U.S. Patent Publication No. 2008/0040984. Thus, the angles between the top openings and the bottom openings, respectively, can generally form an equilateral triangle as discussed above and the offset between the top and bottom openings as described above with respect to FIG. 2 can be generally the same as that of the offset between the icosahedrons as shown in FIGS. 6 and 7. Similarly, the passageways that are present between fluidly connected top and bottom openings can correspond to a structural linking member 185 that provides structural rigidity to an icosahedral array. Thus, by generally forming the structure of an icosahedral array, an array of structural members 100 as described herein can have increased structural integrity.

Referring again to FIGS. 6 and 7, it can also be seen that the basic structure of the structural members 100 generally comprises tetrahedrons, with the members 175 generally providing the location of the vertices of two tetrahedrons. For example, the top three members 175 and the middle member 175 can form one tetrahedron and the bottom three members 175 and the middle member 175 form a second tetrahedron, with the center of each member 175 approximating the vertices of each of the tetrahedrons. As shown in FIG. 7, the two tetrahedrons formed by members 175 can be offset at an angle relative to one another. The angle or offset can be approximately 60 degrees as described with respect to the offset shown in FIG. 2.

Figure 8:
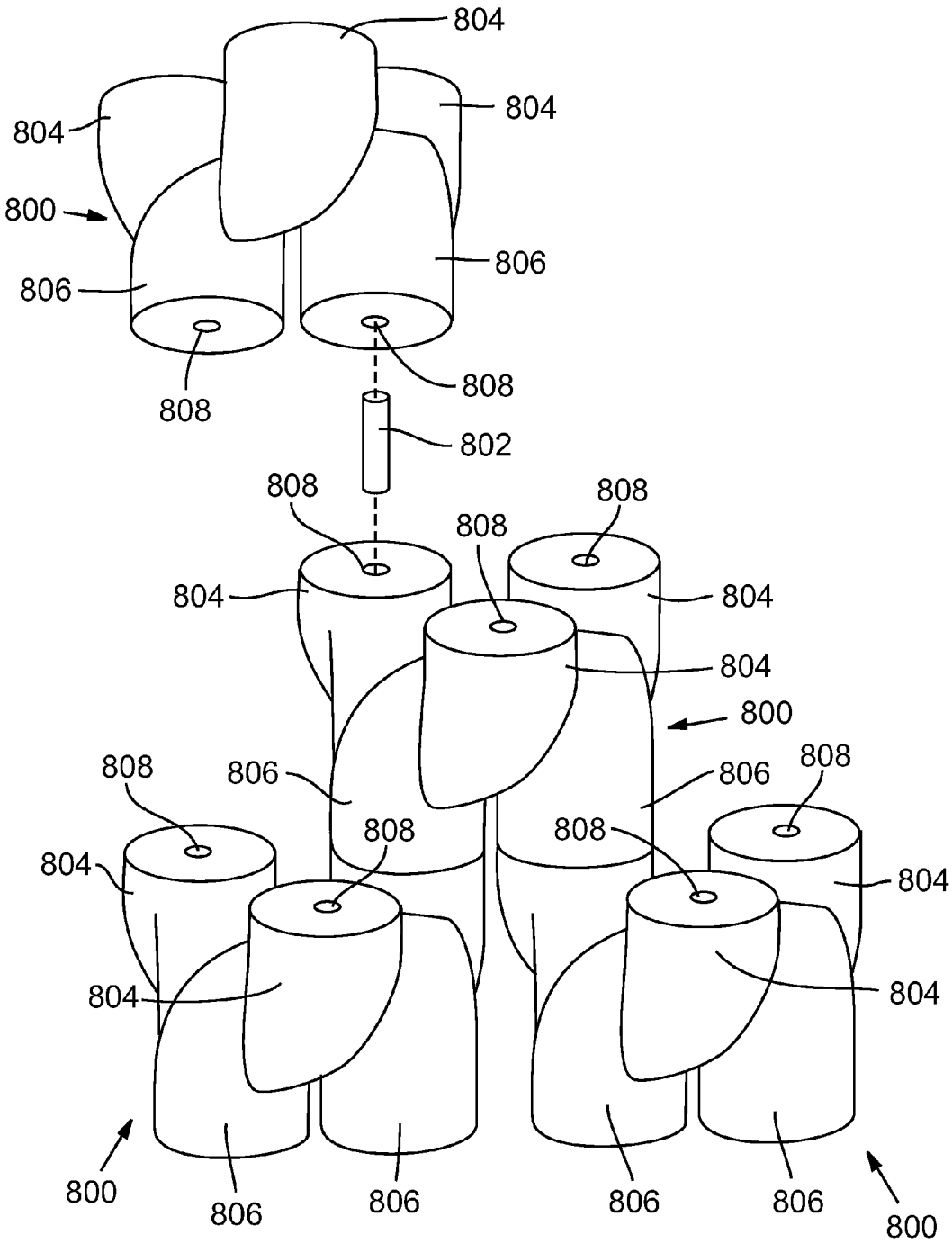
FIG. 8 is a schematic perspective view of a plurality of substantially solid structural members coupled together to form an away of structural members.

In another embodiment, structural members can be substantially solid, rather than substantially hollow. For example, as shown in FIG. 8, structural members 800 can comprise be substantially solid and can be coupled together using various other mechanisms, such as by mechanical and/or chemical bonds. The plurality of structural members 800 shown in FIG. 8 form an array by coupling members together via connecting members 802. In the illustrated embodiment, each of the three top extending members 804 and three bottom extending members 806 can comprise openings 808 that can receive connecting members 802. Connecting members 802 therefore function to couple one structural member 800 to another structural member 800 to form an omni-extensible array. Connecting members 802 can be a dowel pin elements as shown in FIG. 8. Alternatively, other coupling members can be used. In addition, connecting members 802 can be formed integral with one structural member or they can be separate elements like the dowel pins shown in FIG. 8.

The materials of the structural member can vary and be the same as the materials of the hollow members described above. One particularly useful material can be crumb rubber, which is readily available from recycled tire products. Crumb rubber can also be useful because it is relatively resilient and can provide a structure that is relatively elastic and, at the same time, very durable.

The arrays of structural members as described herein are desirably formed in a "structured and ordered" manner. That is, that each structural member in the array is positioned, placed, or otherwise formed in a non-random manner. The ordered nature of the array makes it predictable in both its structural integrity as well as in its ability to receive additional functional elements as discussed below. Structurally, the ordered nature of the array means that it will perform more predictably than structures that are formed with non-ordered structures (such as concrete). In addition, the ordered nature of the array results in a failure resistance that limits structural damage to the location of the damage, preventing it from spreading to other areas of the array. Accordingly, deformation, damage, and/or other failures can be localized and controlled, thereby maintaining the integrity of the array as a whole.

The material selection for the structural members described herein can include virtually any category of materials that is capable of being constructed into the required shapes. For example, plastics, metals, and wood products can generally be used to form the shapes required.

Furthermore, unlike many construction or structural materials, the array materials can be highly environmentally friendly and reusable. Because the array can be constructed by adding structural elements to the array without mixing materials, epoxies, or other binding agents, the array can also be deconstructed without destroying or damaging the materials of array. Accordingly, the structural members can be easily reused, increasing the environmental friendliness of the array and its components.

Of course, if reusability is not an issue, the array can also be more permanently constructed using epoxies or other binding agents. In addition to using epoxies or binding agents in the array itself, the array can also form a structural base for other permanent building materials. For example, concrete could be poured onto an array structure in order to increase the rigidity of the array structure and of the concrete. The open and permeable architecture of the array creates a structure that is easily filled with concrete or other hardening agents.

The permeability of the array results from the generally hollow configuration of each structural element. Thus, as long as the flowable matter (e.g., fluids, gas, flowable solids) is of a size that is small enough to pass through the passageways of the structural elements, the interconnected passageways of an array of structural members can permit and facilitate the passage of the flowable matter from one surface of the array (e.g., a top surface) to another surface (e.g., a bottom surface). Thus, the resulting configuration is an array that is permeable, breathable, and self draining. The permeability of the array renders it suitable for numerous uses, including, for example, pavement, driveways, marine applications, filtering processes, or any other micro- or mega-scale application in which flowable passageways are desirable. In addition, because of the available flowable passageways, the structural members described herein can be used in connection with heat exchangers to efficiently transfer heat from one medium to another. With the high surface area to volume, the structural members disclosed herein can be particularly well suited for such applications.

Figure 9:
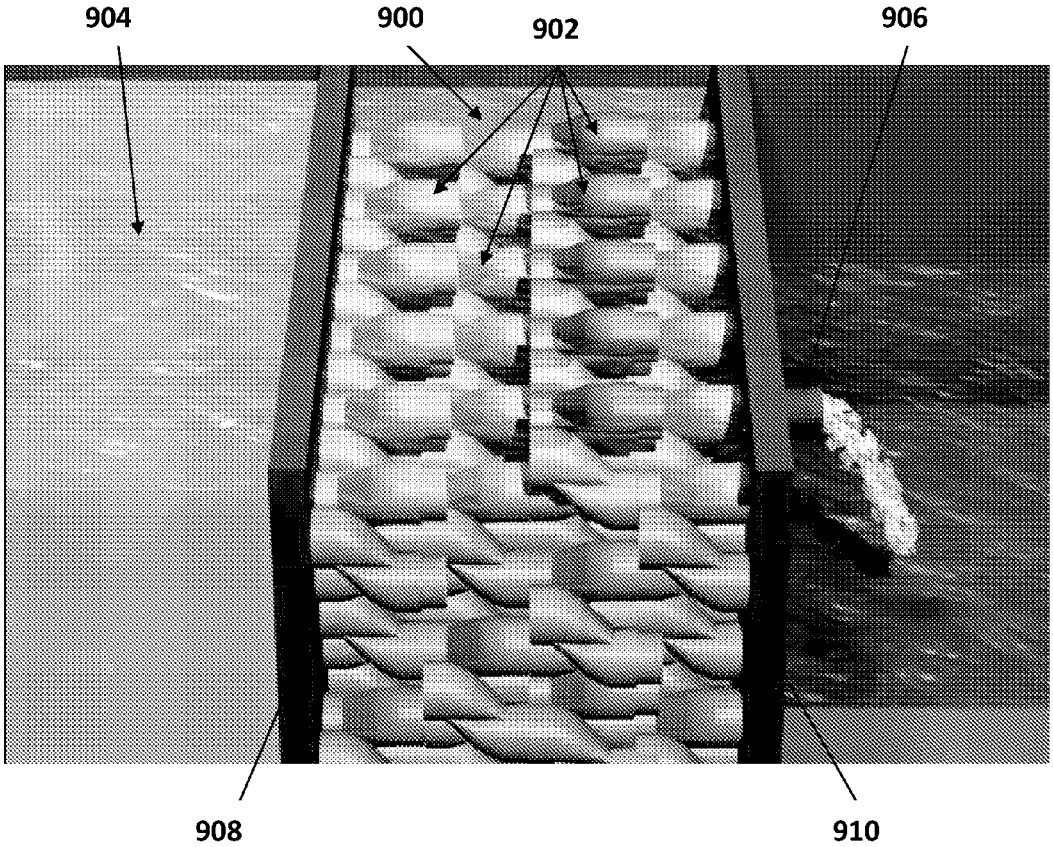
FIG. 9 is a view of an array of structural members configured to allow and/or restrict the passage of water therethrough.

FIG. 9 is a view of an array of structural members configured to allow and/or restrict the passage of water therethrough. For example, an array 900 comprising a plurality of structural members 902 is positioned between a reservoir 904 of water and an outlet 906. Outlet 906 can be coupled to one or more structural members 902 to selectively allow the passage of water (or other fluids) through one or more passageways formed by the array 900 to allow water to move from a first side 908 of the array to a second side 910 of the array.

Moreover, functional elements can be positioned in the passageways of one or more structural members in various ways. For example, as noted above, the array can be filled at least in part with various materials to increase its structural integrity. Thus, one or more interconnected passageways can be filed with concrete or other fillable, hardening materials. These materials can be directed into the array via one or more passageways to further strengthen the array and/or restrict the flow of fluids or other flowable materials through the filled passageways. Thus, the flow patterns that result from the available open passageways in the array can be altered or changed as desired.

In addition to flow-restricting materials, such as concrete, other functional elements can be provided in or delivered through the passageways of the array. For example, filtering materials can be provided to filter particles or other matter from any flowable matter that can be received in the passageways of the array.

Figure 10:
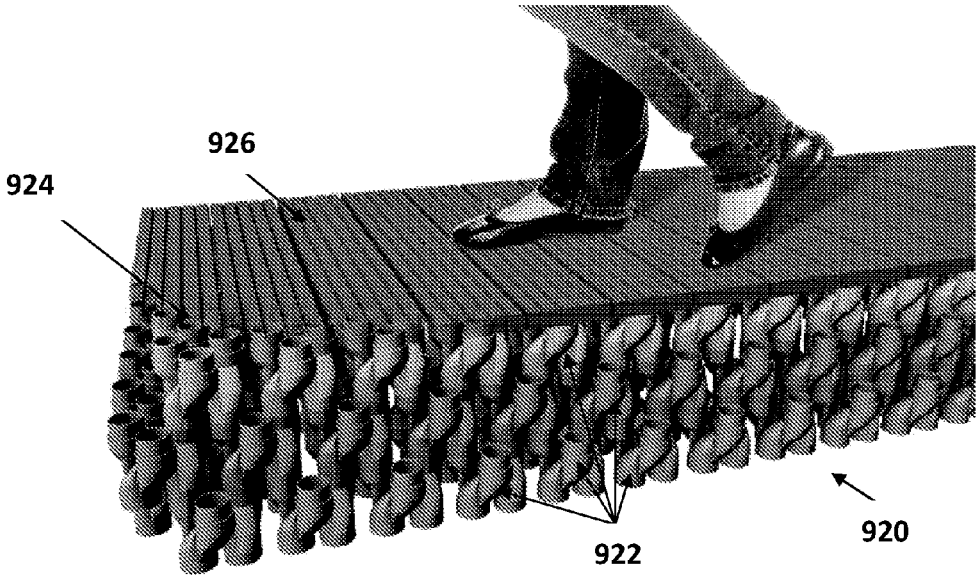
FIG. 10 is a view of an array of structural members configured to form a base for a load bearing surface, such as a walkway.
Figure 11:
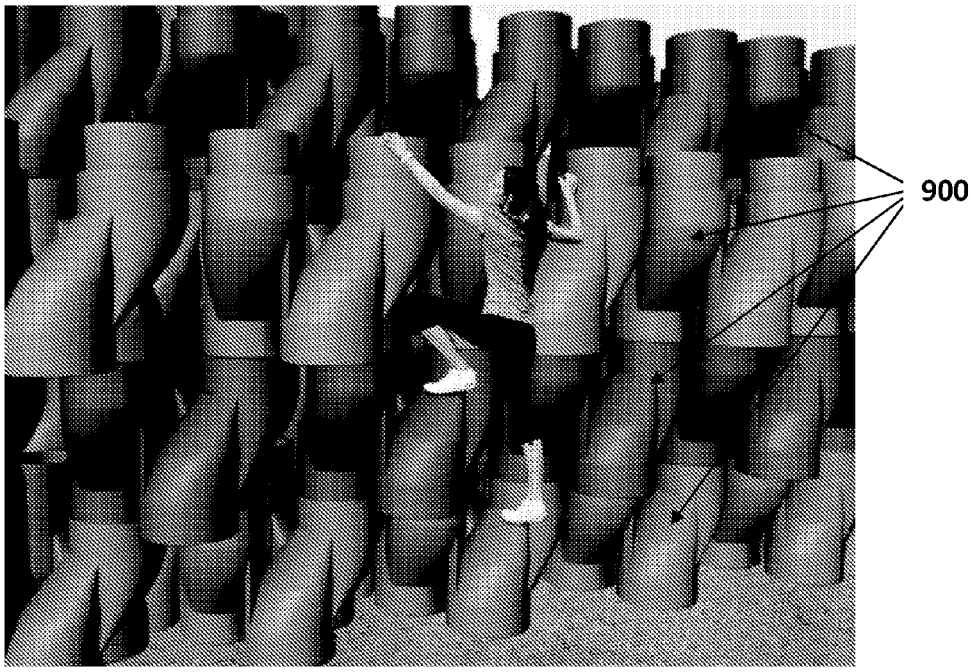
FIG. 11 is a view of an array of structural members that form an array of relatively large size.

In addition, as noted above, the array is scalable in that the size of individual structural elements can be varied ranging from a very small size (e.g., measurable on the nano-scale) to a very large size (e.g., measurable in meters or larger). FIGS. 10 and 11 illustrate some of the variation in size that such an array can have. For example, in FIG. 10, the structural array 920 comprises an array of three layers of structural members 922 that are coupled (e.g., stacked) to form a load bearing surface 924. Each structural member are preferably smaller than about one foot in height (e.g., about 3 inches to 8 inches high) to form such a load bearing surface, although other size structural members can be utilized for such purposes. The load bearing surface formed by the top faces of the structural members (or another structural member positioned above the array) can carry or support a base or platform 926 to form a walkway as shown in FIG. 10.

FIG. 11 illustrates another embodiment, where the structural members 940 are formed in much larger sizes than shown in FIG. 10. As seen in FIG. 11, structural members 940 can each be about 2-4 feet in height. Each of these structural members 940 are coupled together to form an array that comprises at least four layers of structural members.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A plurality of structural members configured to be coupled together to form an array, each structural member comprising:

a top portion having a plurality of top extending members spaced apart from one another; and a bottom portion having a plurality of bottom extending members spaced apart from one another, the top extending members and bottom extending members being vertically offset from each other, wherein the top portion of each structural member is configured for coupling to the bottom portion of another structural member, and each top extending member of a structural member is configured to be coupled to a bottom extending member of another structural member, wherein the structural members have three top extending members and three bottom extending members, and the three top extending members are formed with a same height so that coupling of the plurality of structural members to one another results in a plurality of layers having a uniform height, wherein each of the plurality of top extending members has a first opening and each of the plurality of bottom extending members has a second opening, and a passageway extends between each first opening and a corresponding, offset second opening.

2. The plurality of structural members of claim 1, wherein each of the plurality of top extending members has a first opening and each of the plurality of bottom extending members has a second opening, and respective ones of the first openings of the top extending members are offset from respective ones of the second openings of the bottom extending members along a central axis of the structural member by about 60 degrees.

3. The plurality of structural members of claim 1, wherein each top extending member and bottom extending member comprises a connector-receiving opening, the plurality of structural members further comprising a plurality of connecting members, each connecting member having a first end that is received into a connector-receiving opening of one top extending member and a second end that is received into a connector-receiving opening of one bottom extending member.

4. The plurality of structural members of claim 1, wherein each structural member is substantially solid.

5. The plurality of structural members of claim 1, wherein each first opening of a first structural member is fluidly connected to only one second opening of the first structural member.

6. The plurality of structural members of claim 1, wherein at least one passageway has a convoluted path between the first opening and the second opening.

7. The plurality of structural members of claim 1, wherein each structural member comprises three first openings and three second openings, and each of the three first openings has a centerpoint and the three centerpoints of the first openings define a first equilateral triangle, and each of the three second openings has a centerpoint and the three centerpoints of the second openings define a second equilateral triangle.

8. The plurality of structural members of claim 7, wherein the first equilateral triangle is larger than the second equilateral triangle.

9. The plurality of structural members of claim 1, wherein each of the first openings of the structural members is defined by an extending portion and each of the second openings of the structural member is configured to receive an extending portion of another structural member at least partially into the second opening to couple the two structural members together.

10. The plurality of structural members of claim 9, wherein each extending portion of a first structural member is configured to be received at least partially into the second opening of a different structural member, such that three extending portions of a first structural member can be coupled to three other structural members.

11. The plurality of structural members of claim 10, further comprising a movement restricting member to restrict relative movement of two coupled structural members when at least one extending portion is received in the second opening of another structural member.

12. The plurality of structural members of claim 11, wherein the movement restricting member comprises a lip on one or both of the extending portions and the second openings.

13. A plurality of structural members configured to be coupled together to form an array, each structural member comprising:

a top face having three first joining members arranged such that a plurality of centerpoints of the first joining members collectively define a first equilateral triangle in a first plane; and a bottom face having three second joining members such that a plurality of center points of the second joining members collectively define a second equilateral triangle in a second plane that is generally parallel to the first plane;

wherein at least some of the first joining members of the structural members are configured to mate with at least some of the second joining members of other structural members to couple the plurality of structural members together, wherein the first and second equilateral triangles are offset from one another along a central axis of the structural member by an angle of about 60 degrees.

14. The plurality of structural members of claim 13, wherein the first equilateral triangle is larger than the second equilateral triangle.

15. The plurality of structural members of claim 13, wherein each first joining member of a first structural member is configured to be joined with one of the second joining members of a different structural member, such that the three first joining members of the first structural member are coupled to three other structural members.

16. The plurality of structural members of claim 15, wherein the first joining members comprise extending portions that extend from the top face of the structural members and the second joining members comprise openings that are sized to receive the first joining members of another structural member.

17. The plurality of structural members of claim 16, further comprising a movement restricting member to restrict relative movement of two coupled structural members when at least one extending portion is received in the second opening of another structural member.

18. The plurality of structural members of claim 17, wherein the movement restricting member comprises a lip on one or both of the extending portions and the second openings.

19. An omni-extensible array of structural elements comprising:

a first layer of a plurality of structural elements; and a second layer of a plurality of structural elements, wherein the structural elements comprise:

a top face having three first joining members arranged such that a plurality of centerpoints of the first joining members collectively define a first equilateral triangle in a first plane; and a bottom face having three second joining members such that a plurality of center points of the second joining members collectively define a second equilateral triangle in a second plane that is generally parallel to the first plane;

wherein at least some of the first joining members are configured to mate with at least some of the second joining members to couple the first layer of structural elements to the second layer of structural elements, wherein the first equilateral triangle is larger than the second equilateral triangle.

20. The array of claim 19, wherein each structural element in the array can be coupled to three different structural elements in a layer above the structural element and three different structural elements in a layer below the structural element.

21. The array of claim 19, wherein the first and second equilateral triangles of each structural member are offset from one another relative to a central axis of the structural member by an angle of about 60 degrees.

* * * * *